US005507223A

United States Patent [19]

Vallius

[11] Patent Number: 5,507,223

[45] Date of Patent: Apr. 16, 1996

[54] ARRANGEMENT FOR COUPLING EXTENDED-NIP ROLLS

[75] Inventor: Oiva Vallius, Jyväskylä, Finland

[73] Assignee: Valmet Paper Machinery, Inc., Helsinki, Finland

[21] Appl. No.: 242,440

[22] Filed: May 13, 1994

[30] Foreign Application Priority Data

Feb. 4, 1994 [FI] Finland ..... 940522

[51] Int. Cl.[6] ..... B30B 3/04; D21F 3/00

[52] U.S. Cl. ..... 100/153; 72/238; 100/168; 162/272; 162/358.3; 425/194

[58] Field of Search ..... 100/153, 168, 100/170, 176; 72/238; 162/272, 273, 358.3; 425/194

[56] References Cited

U.S. PATENT DOCUMENTS

| | | | |
|---|---|---|---|
| 2,277,313 | 3/1942 | Fowler | 425/194 |
| 2,512,648 | 6/1950 | Hornbostel | 100/168 |
| 3,049,074 | 8/1962 | Mellin | 100/168 |
| 3,845,708 | 11/1974 | Liebert | 100/168 |
| 3,921,514 | 11/1975 | Biondetti | 100/162 B |
| 4,095,448 | 6/1978 | Gipperich | 72/238 |
| 4,790,908 | 12/1988 | Roerig et al. | 162/272 |
| 5,404,811 | 4/1995 | Schiel et al. | 100/153 |

FOREIGN PATENT DOCUMENTS

| | | | |
|---|---|---|---|
| 0107607 | 5/1984 | European Pat. Off. . | |
| 57653 | 8/1974 | Finland . | |
| 1961110 | 6/1971 | Germany | 72/238 |
| 9103795 | 6/1992 | Germany . | |
| 4219503 | 12/1993 | Germany . | |

*Primary Examiner*—Stephen F. Gerrity
*Attorney, Agent, or Firm*—Steinberg, Raskin & Davidson

[57] ABSTRACT

A coupling construction for coupling an extended-nip press roll including a loading shoe for loading a belt mantle to press the belt mantle toward a back-up roll. The coupling construction includes pivotally linked tie members for detachably connecting the bearing housings of the extended-nip press roll and the back-up roll so that the tie members are connected with either bearing housing and the roll in the other bearing housing is serviceable.

14 Claims, 8 Drawing Sheets

ARRANGEMENT FOR COUPLING EXTENDED-NIP ROLLS

BACKGROUND OF THE INVENTION

The present invention relates to a coupling construction for coupling press rolls forming a nip in which a large linear load exists, particularly an extended-nip, and a method for joining together a pair of rolls in a nip in which a large linear load exists, especially an extended-nip.

A press nip formed between a pair of extended-nip rolls typically consists of a pair of rolls such as SYM-ZL and SYM-BELT rolls. A special feature of an extended-nip is the high linear load applied therein to dewater the web. The maximum linear load is generally of an order of about 1200 kN/m. For such a relatively high linear load, a conventional screw coupling arrangement for the rolls is not possible, because, in order to overcome the linear load, roughly 130 screws per roll would be needed. This would be uneconomical in practice.

OBJECTS AND SUMMARY OF THE INVENTION

It is an object of the present invention to provide a new and improved method and device for coupling a pair of rolls forming a nip in extended-nip.

It is another object of the present invention to provide a new and improved coupling construction and method for joining a pair of rolls in an extended-nip which is sufficiently simple and easily operable and which coupling construction does not require a large amount of space.

It is yet another object of the present invention to provide a new and improved coupling construction and method for joining a pair of rolls in an extended-nip which enables one of the rolls to be easily serviceable and/or replaceable without significantly interfering with the positioning of the other roll.

Accordingly, to achieve these objects and others that will come out later, in the invention, tie members are provided to join together and couple the bearing housings of the rolls in a nip in which a large linear load exists, particularly an extended-nip press. The tie members are connected with the bearing-housing constructions so that, when the coupling is being uncoupled, the tie members can be pivoted into such a position that the uncoupled roll/mantle belt/bearing can be removed.

Each tie member is linked with one of the bearing housings. The tie member is arranged to pivot in relation to the bearing housing and so that the end of the tie member is locked by means of a wedge effect with the respective bearing housing. Movement of the tie member takes place by means of a hydraulic cylinder or other suitable pivot means. In a preferred embodiment, two tie members are employed at each roll end, and the coupling construction is symmetric in relation to the vertical central axis (Y axis) of the construction, which preferably aligns with axis passing through the center points of the press rolls in the extended-nip. Further, the coupling arrangement comprises an articulation point at each end of the tie member which permits the tie member to be operated as desired so that the tie member is linked in such a manner so as to be pivoted at either one of the bearing housings, either the upper or the lower bearing housing. In this manner, it is possible to condition/replace either the upper bearing housing or the lower bearing housing or to condition/replace either the upper roll or the lower roll. For example, it is easy to replace the belt mantle around the extended-nip press roll by uncoupling the connection between the bearing housings of this roll and pivoting the tie members about an articulation point in connection with the bearing housing of the back-up roll.

In the coupling construction and method in accordance with the invention, the ultimate fixing of the tie member to the constructions of the bearing housing is carried out by means of screw members or equivalent fastening means. In a corresponding manner, the uncoupling of the tie member from the friction joint is carried out, in the first stage, by means of the unscrewing of screw members or unfastening the equivalent fastening means. The shifting of the tie member itself apart from the bearing housing in operative engagement therewith takes place by means of a hydraulic cylinder.

The coupling construction in accordance with the invention is sufficiently simple and, yet, easily operable. Also, the coupling construction does not require a large amount of space and the nip forces do not have to be transferred to the frame constructions. In this case, an expensive and spacious outside frame system is not required providing additional savings. The coupling construction of the invention is also well suitable for modernizations of existing extended-nips.

In the method in accordance with the invention, the coupling construction between the extended-nip press rolls comprises pivotally linked tie members by whose means the extended-nip press rolls have been connected together detachably by the intermediate of their bearing housings. The tie member is connected with either one of the bearing housings, e.g., the upper one connected to the upper roll in the nip or the lower one connected to the lower roll in the extended-nip press.

In the device in accordance with the invention, the extended-nip press rolls are joined together by their ends by means of two tie members. The tie members are placed symmetrically in relation to the vertical axis (Y axis) and can be selectively connected with either one of the bearing housings. As such, by means of the selective coupling, either the upper bearing housing or the lower bearing housing (and roll connected thereto) can be removed/serviced.

The invention will be described in the following with reference to some preferred embodiments of the invention illustrated in the figures in the accompanying drawings. However, the invention is not supposed to be confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
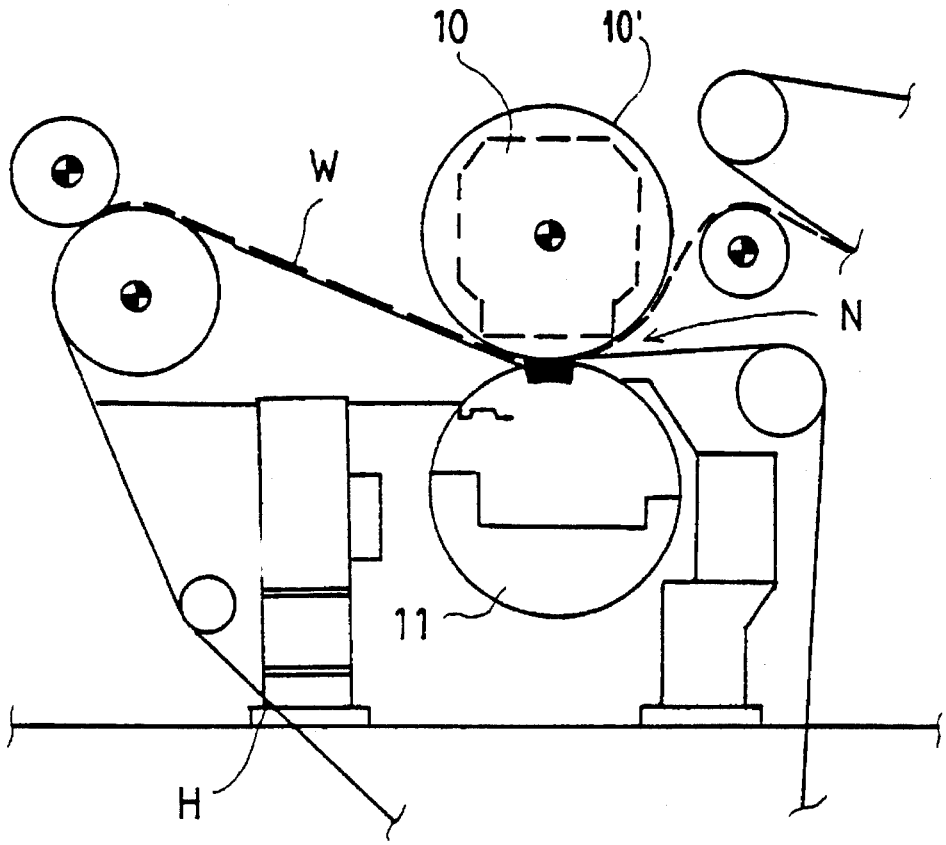
FIG. 1 is a side view of an extended-nip press arrangement of a paper machine/board machine.

Referring to the accompanying drawings wherein like numerals refer to the same elements, FIG. 1 shows an extended-nip press arrangement of a paper machine. In the press arrangement shown in FIG. 1, a web W is passed into a nip N formed between a lower extended-nip press roll 11 and a back-up roll 10. The web W is carried on a felt H into contact with a roll face 10' of the back-up roll 10 in the nip N.

Figure 2:
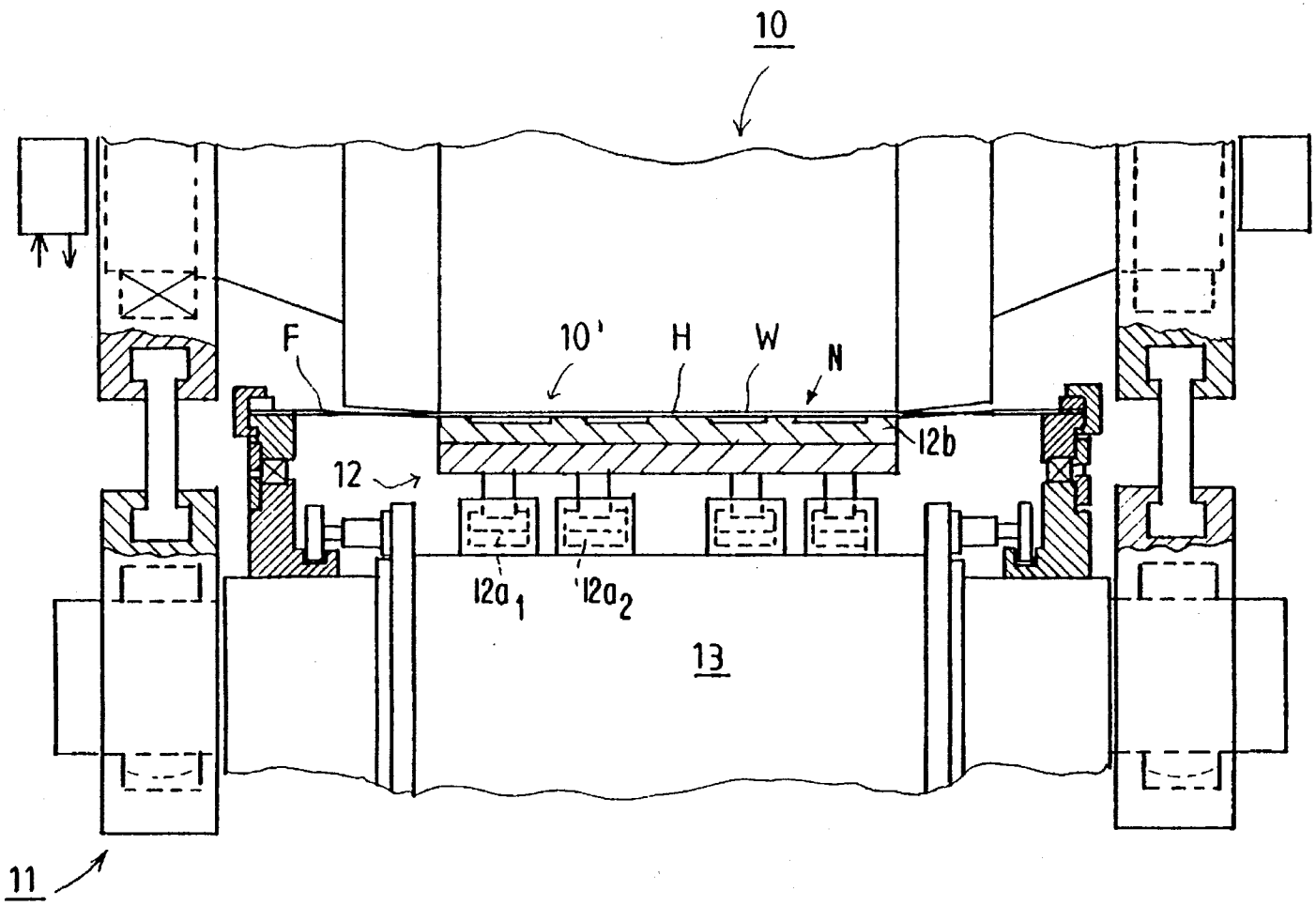
FIG. 2 shows the extended-nip press arrangement viewed in the machine direction and partly in section.

FIG. 2 shows the rolls 10 and 11 of FIG. 1 viewed in the machine direction. The extended nip between the rolls 10 and 11 is denoted in the figure by the reference arrow N. The felt H and the web W carried thereon are passed through the nip N. The roll 10 is a variable-crown back-up roll, and the roll 11 is an extended-nip press roll that comprises loading means $12a_1$,$12a_2$ . . . The loading means $12a_1$,$12a_2$ . . . , preferably cylinder means mounted on the central axle 13, are arranged to act with a force upon a loading or glide shoe **12*b*. The force is conveyed through a flexible closed glide-belt mantle F to the web W so as to remove water from the web. In the present invention, the term web W refers to a paper or board web. The lower extended-nip press roll 11 comprises a flexible closed glide-belt mantle F arranged to run along the face of the loading shoe, i.e., of the glide shoe 12*b*. An oil medium is passed into the space between the glide shoe 12*b* and the closed glide-belt mantle F to constitute the lubrication medium. The back-up roll 10 may be preferably a roll heated from inside by means of a heating medium, e.g., water, steam or oil, or from external sources, e.g., by means of induction or infrared heating. The back-up roll 10** may also be a non-heated roll.

Figure 3A:
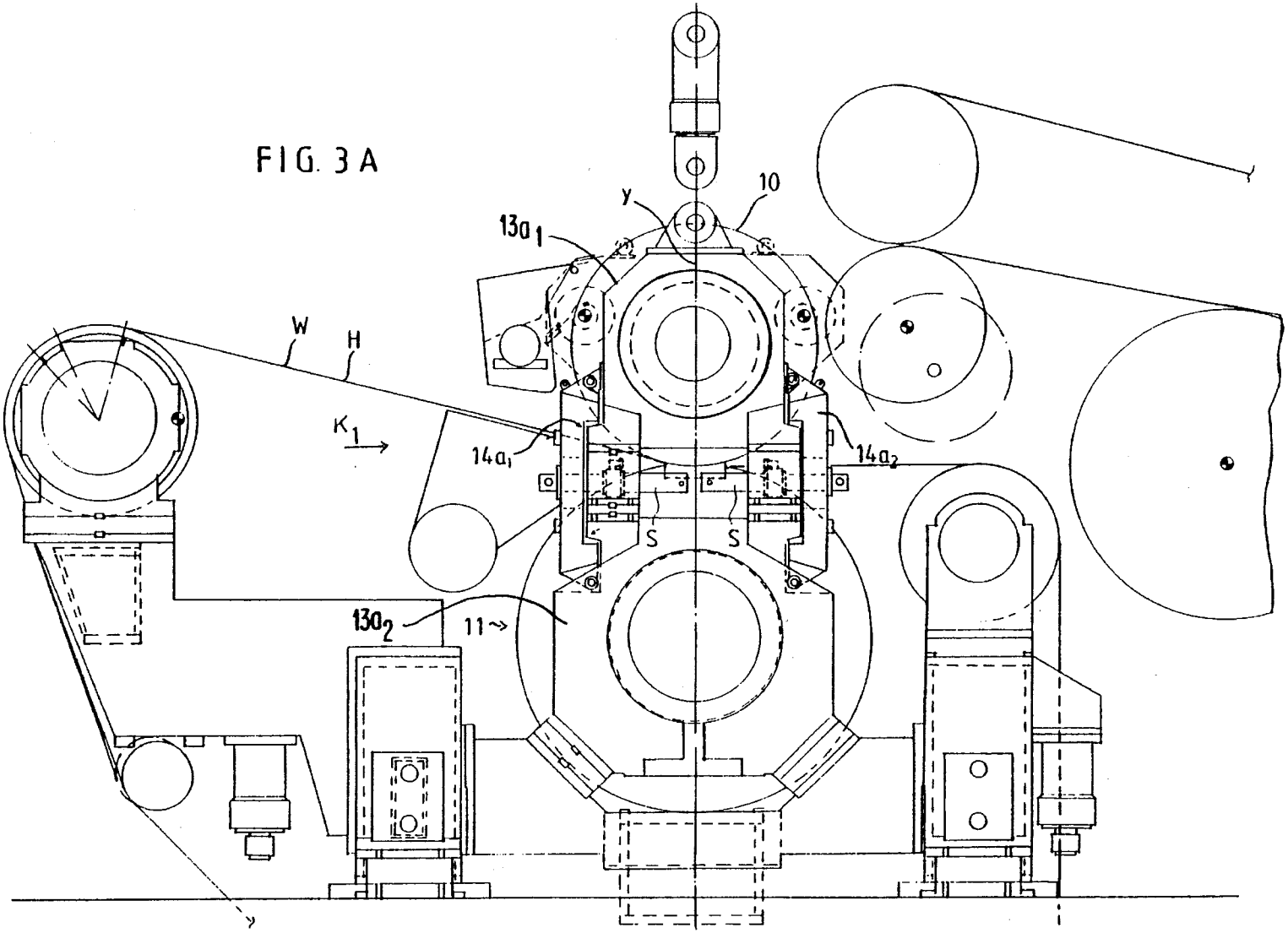
FIG. 3A shows an extended-nip press arrangement in accordance with the invention with the rolls of the extended-nip press joined together at their respective bearing housings.

FIG. 3A shows a coupling construction in accordance with the invention in a position between the rolls in an extended-nip press. In the arrangement, a first bearing housing $13a_1$, which is the upper bearing housing in the figure, and the second bearing housing $13a_2$, which is the lower bearing housing as shown in the figure, and, the respective upper and lower rolls mounted in the bearing housings $13a_1$,$13a_2$, are interconnected by means of tie members $14a_1$ and $14a_2$. In a preferred embodiment, the bearing housings are interconnected by means of similar tie members $14a_1$ and $14a_2$ at both ends of the rolls.

Figure 3B:
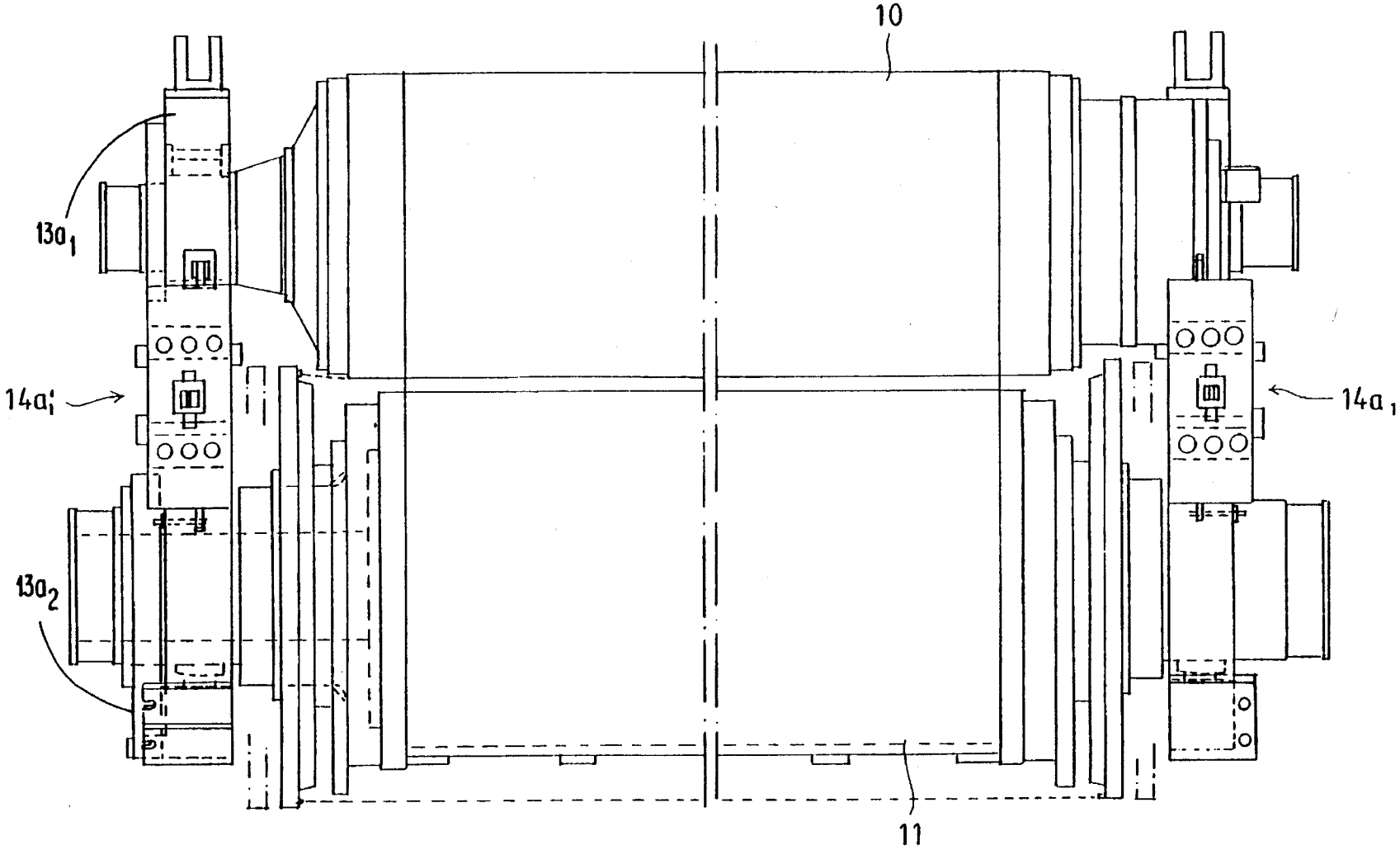
FIG. 3B shows the arrangement as shown in FIG. 3A viewed in the direction of the arrow $K_1$ in FIG. 3A.

FIG. 3B shows the coupling construction shown in FIG. 3A, viewed in the direction of the arrow $K_1$ in FIG. 3A.

Figure 4A:
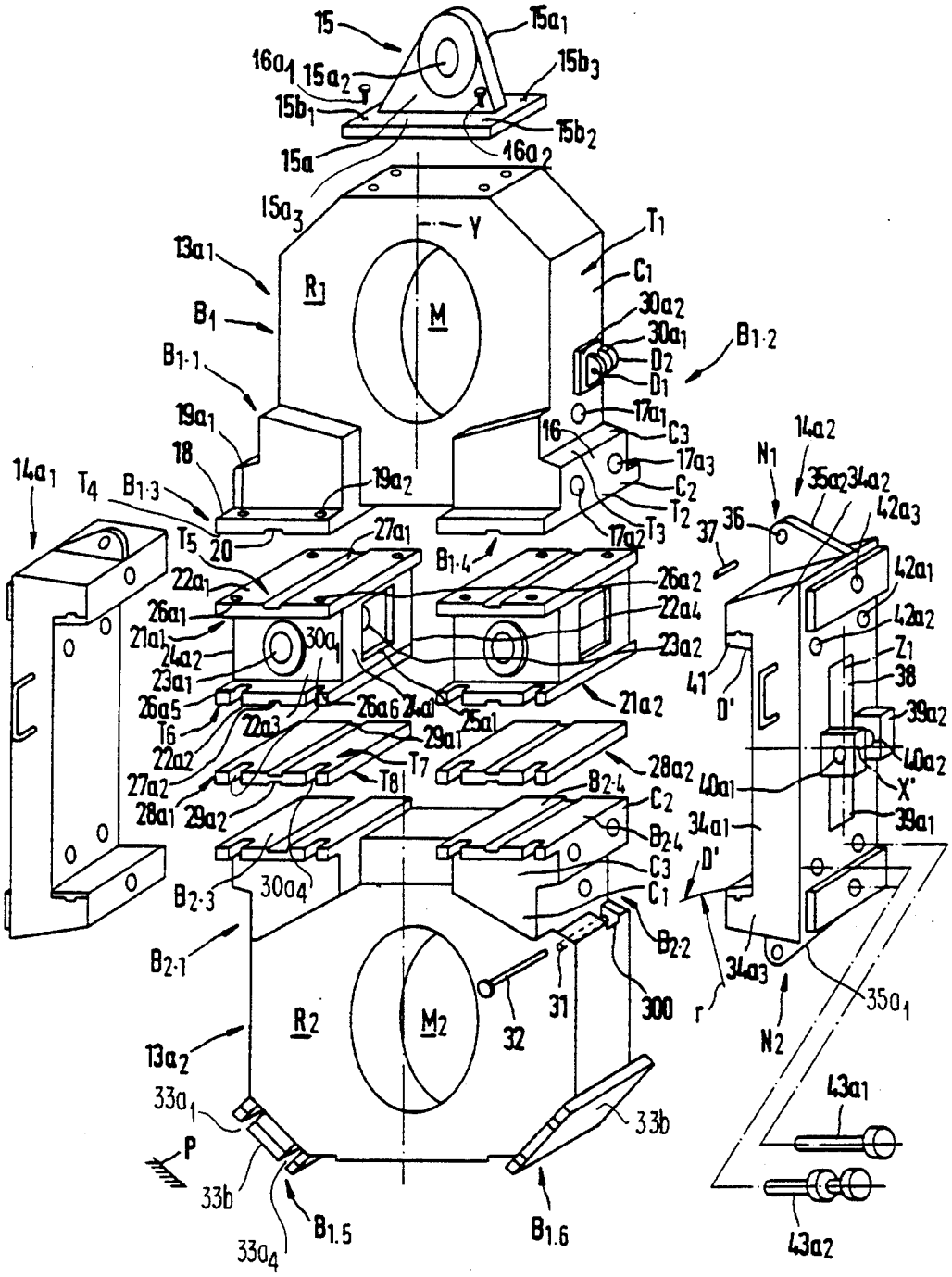
FIG. 4A is an axonometric exploded view of the parts of the coupling construction between the rolls in the arrangement shown in FIGS. 3A and 3B.

FIG. 4A is an axonometric exploded view of the parts of the coupling construction in accordance with the invention. The tie members $14a_1$, $14a_1$' connected both ends of the rolls.

The fastening construction in accordance with the invention is symmetric in relation to the vertical axis (Y axis). The coupling construction is also substantially symmetrical in relation to the second axis (X axis) perpendicular to the Y axis.

The first bearing housing, which is the upper bearing housing $13a_1$ as shown in FIG. 4A, includes a lifting bracket 15. The lifting bracket 15 comprises a bracket part $15a_1$ having a through hole $15a_2$ therein which mates with the loop of the lifting device, and a plate part $15a_3$ connected with the bracket part $15a_1$. Plate part $15a_3$ is attached to the frame $R_1$ of the bearing housing $13a_1$ by means of screw means $16a_1$,$16a_2$, . . . The screws $16a_1$,$16a_2$, . . . are passed through screw holes $15b_1$,$15b_2$, . . . into the frame $R_1$ and are threaded into the threaded holes in the frame.

The bearing housing $13a_1$ comprises a lower fastening construction $B_1$. The fastening construction $B_1$ is symmetric in relation to the Y axis and comprises similar fastening-construction portions $B_{1.1}$,$B_{1.2}$. The frame $R_1$ is preferably a cast construction. The frame $R_1$ comprises a central opening M for the axle of the upper roll. In the figures, the bearing means on which the rolls revolve are not shown separately. The frame comprises a side face $C_1$ and therein a plane surface $T_1$. On the side face $C_1$, there is a side projection 16 comprising a face $C_2$. The face planes $T_1$ and $T_2$ of the faces $C_1$ and $C_2$ are preferably parallel to one another, and are connected by a coupling face $C_3$ arranged inclined in relation to the planes $C_1$,$C_2$. The side face $C_1$ comprises a screw hole $17a_1$ and, in a corresponding manner, the face $C_2$ comprises screw holes $17a_2$,$17a_3$. The face $C_1$ further comprises a bracket $30a_1$,$30a_2$ having aligning shaft holes $D_1$,$D_2$ arranged therein.

The frame $R_1$ further comprises coupling means $B_{1.3}$,$B_{1.4}$ which are similar to one another and which are placed at both sides of the Y axis. For example, the coupling means $B_{1.3}$ comprise a plane face $T_4$ and therein a projection edge 18 which comprises screw holes $19a_1$,$19a_2$ as well as a keyway 20 in the bottom face.

Further, the coupling construction comprises hollow middle frames $21a_1$,$21a_2$, which are constructions similar to one another. In the following, one of these middle frames, the middle frame $21a_1$, will be described. The middle frame $21a_1$ comprises an upper wall $22a_1$, a lower wall $22a_2$, and side walls $22a_3$,$22a_4$ which interconnect the upper and the lower walls perpendicularly and which comprise holes $23a_1$, $23a_2$ for the shaft of the pivot cylinder S so that the cylinder S pivots about the shaft inserted through the holes $23a_1$, $23a_2$. Between the side walls $22a_3$,$22a_4$, there are side walls $24a_1$,$24a_2$ between the upper and the lower walls $22a_1$,$22a_2$. The side walls $24a_1$,$24a_2$ comprise respective openings $25a_1$,$25a_2$ (of which only opening $25a_1$ can be seen in the figure). The walls mentioned above define a hollow space E in the interior space between them. A hydraulic cylinder is arranged partly in the space by its cylinder frame so that the shaft connected with the cylinder frame is connected and linked pivotally in the axle holes $23a_1$,$23a_2$. The upper and the lower walls $22a_1$,$22a_2$ project by their ends from the side walls, and their projection portions comprise screw holes $26a_1$,$26a_2$, . . . and grooves $26a_5$,$26a_6$, . . . for the screws. Moreover, the upper wall $22a_1$ comprises a plane face $T_5$ and therein a keyway $27a_1$ and, correspondingly, the lower wall part $22a_2$ comprises a plane face $T_6$ and therein a keyway $27a_2$. In FIG. 4A, the screws or other fastening means which connect the middle frame $21a_1$,$21a_2$ to its bearing housings are not shown separately.

The arrangement further comprises adapter pieces $28a_1$, $28a_2$, which are construction parts similar to one another. For example, the adapter piece $28a_1$ comprises an upper planar face $T_7$ and a lower planar face $T_8$ and keyways 29$a_1$,29$a_2$ in the planar faces, respectively. Further, the adapter piece comprises grooves 30$a_1$, . . . ,30$a_4$ for receiving the fastening means, e.g., screws.

The lower, second bearing housing 13$a_2$ comprises a frame $R_2$, preferably a cast frame, and therein a central hole $M_2$ through which the axle of the lower roll is positioned. The bearing housing 13$a_2$ comprises upper fastening means $B_{2.1}$,$B_{2.2}$ which are constructions substantially similar to one another and which correspond to the fastening and coupling means $B_{1.1}$,$B_{1.2}$ of the upper bearing housing 13$a_1$. Thus, they are constructions symmetric in relation to the central axis Y. Similar to the upper bearing housing, the fastening means in the lower bearing housing 13$a_2$ comprise a first face $C_1$, a second face $C_2$ which has been raised in relation to the first face $C_1$, and between the first and second faces, a third face $C_3$ which is a coupling face. The face $C_3$ is preferably an inclined face. Further, a fourth face $C_4$ comprises a groove 300 for a bracket, and a hole 31 in the frame $R_2$, whereby it is possible to pass a shaft 32 through the hole 31 and through a corresponding hole provided in the fastening bracket of the tie member which is placed in the groove 300 for the bracket.

The uppermost fastening portion $B_{2.3}$,$B_{2.4}$ of the upper fastening means $B_{2.1}$,$B_{2.2}$ are constructions similar to one another and similar to the fastenings $B_{1.3}$ and $B_{1.4}$ of the upper bearing housing. Further, the lower bearing housing comprises lower fastening means $B_{1.5}$ and $B_{1.6}$ which are similar to one another. The lower fastening means $B_{1.5}$ and $B_{1.6}$ comprise a plate 33*b* and grooves 33$a_1$, . . . ,33$a_4$ arranged therein for screws which enable the entire coupling construction to be fixed to a machine foundation P.

At the ends of the rolls, interconnecting the bearing housings, there are two similar tie members 14$a_1$ and 14$a_2$. Each tie member 14$a_1$,14$a_2$ comprises a middle frame 34$a_1$ and side frames 34$a_2$,34$a_3$ at both ends of the middle frame 34$a_1$. The longitudinal axes of the side frames 34$a_2$,34$a_3$ are substantially perpendicular to the longitudinal axis $Z_1$ of the middle frame. The tie members 14$a_1$,14$a_2$ are elongate and symmetrically arranged in relation to the central axis X', i.e., the longitudinal axis. Each tie member comprises an articulation point $N_1$,$N_2$ at its ends, in which case the tie member can be connected optionally with either one of the bearing housings. A bracket 35$a_1$,35$a_2$ is arranged at each end of the middle frame 34$a_1$. The bracket 35$a_1$ includes a hole 36 through which the shaft 37 can be passed in order to couple the tie member with one of the bearing housings via an articulated joint.

In a corresponding manner, the other end of the tie member comprises a similar bracket construction 35$a_2$ by whose means the tie member can be coupled optionally, via an articulated joint, with the other bearing housing. Further, the tie member 14$a_1$, 14$a_2$ comprises a handle, by whose means the tie member can be displaced by making use of an outside device. The middle frame 34$a_1$ of the tie member comprises a rectangular, central opening 38 passing through the middle frame. Brackets 39$a_1$,39$a_2$ are arranged at respective sides of the opening 38. The brackets 39$a_1$,39$a_2$ comprise through holes 40$a_1$,40$a_2$ for a shaft to pass therethrough, whereby a pivot cylinder S can be coupled with the tie member by the end of the piston rod. The opening 38 is large enough to enable the cylinder S to pivot freely therein about the shaft inserted through the holes 40$a_1$,40$a_2$ upon movement of the tie members 14$a_1$,14$a_2$. Inside the U-section formed between the extending portions of the side frames 34$a_2$,34$a_3$ and the planar rear face of the middle frame 34$a_1$, a wedge piece 41 composed of tin bronze is arranged against the side frames 34$a_2$,34$a_3$. The wedge piece has a coupling face D' which is preferably a cylindrical face having a curve radius r. The middle frame 34$a_1$ further comprises screw holes 42$a_1$,42$a_2$ and 42$a_3$ arranged on respective sides of the opening 38. Tightening screws 43$a_1$, 43$a_2$ are passed through the holes 42$a_1$ and 42$a_2$, and a detaching and tightening screw 43$a_3$ is passed through the hole 42$a_3$.

Figure 4B:
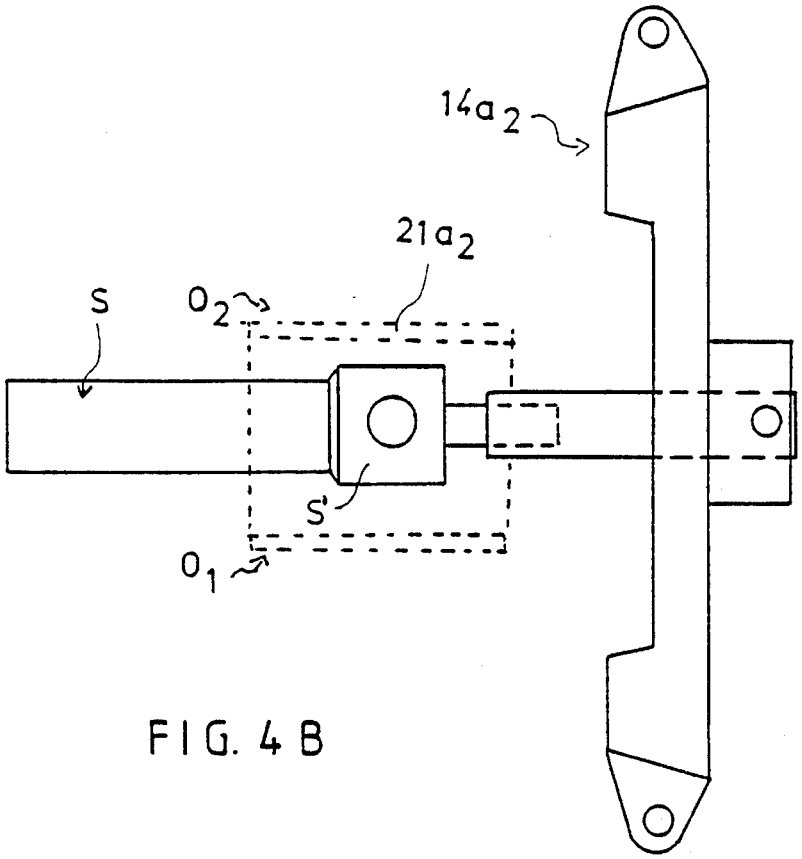
FIG. 4B illustrates the engagement of the cylinder S with the middle frame $21a_2$ and with the tie member $14a_2$.

FIG. 4B is an illustration on an enlarged scale of the engagement of the tie member 14$a_1$ with the cylinder device S which serves to actuate the coupling construction. The cylinder S, which is preferably a hydraulic cylinder, is coupled by its cylinder frame S' with the middle frame 21$a_1$. The middle frames 21$a_1$ and 21$a_2$ can be coupled by separate screw means (not shown) both with the upper bearing housing 13$a_1$ and with the lower bearing housing 13*a*2. The coupling mentioned above also permits that the tie members 14$a_1$,14$a_2$ can be coupled operationally either with the upper bearing housing or with the lower bearing housing. When the tie member 14$a_2$,14$a_1$ is linked to pivot in relation to the upper bearing housing 13$a_1$, when the coupling between the rolls is being uncoupled, the coupling means connected with the middle frame 21$a_1$,21$a_2$ are detached from the lower edge of the middle frame 21$a_1$,21$a_2$ (in FIG. 4B, this edge is denoted with $O_1$ at the part 21$a_2$). Similarly, if the tie member 14$a_1$,14$a_2$ is linked to pivot in relation to the lower bearing housing 13*a*2, when the coupling between the rolls is being uncoupled, the bearing means at the edge $O_2$ are detached from the engagement with the upper bearing housing at the edge $O_2$. Thus, the detachable middle frame 21$a_1$,21$a_2$ permits the above selective operation.

Figure 4C:
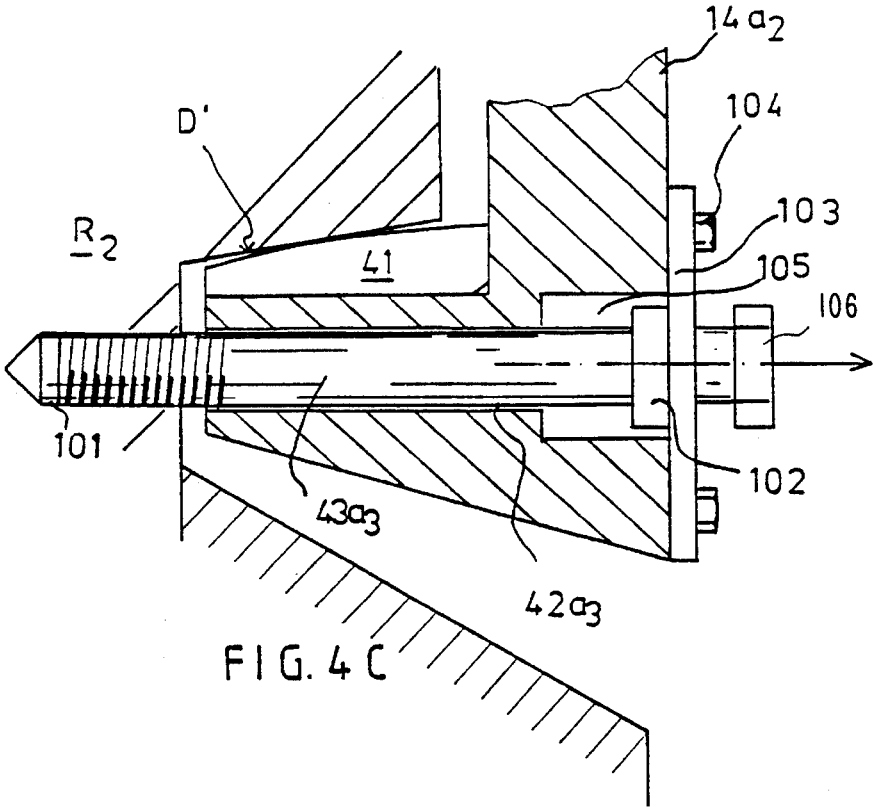
FIG. 4C illustrates the engagement of the tie member $14a_2$ with the frame $R_2$ by means of a screw, by means of which screw the tie member $14a_2$ can also be detached from the engagement with the frame part $R_2$.

FIG. 4C shows the engagement of the tie member 14$a_2$ with the frame $R_2$ by means of the screw 43$a_3$. The screw 43$a_3$ is passed through the screw hole 42$a_3$ placed in the tie member 14$a_2$ into a threaded hole 101 in the frame $R_2$. The screw 43$a_3$ comprises a flange 102. The tie member 14$a_2$ comprises a recess 105 in one of its faces and the flange 102 of the screw 43$a_3$ is placed in this recess. When the screw 43$a_3$ is threaded in one direction, the head 106 of the screw is threaded into contact with a plate part 103, and the tie member 14$a_2$ is thereby pressed into contact with the frame $R_2$. When the member 14$a_3$ is detached from the engagement with the frame $R_2$, the screw 43$a_3$ is threaded in the opposite direction. In this manner, the flange 102 of the screw 43$a_3$, after it has been turned so that it presses against the lower face of the plate part 103, lifts the tie member 14$a_2$ apart from the frame $R_2$. The plate part 103 is fixed to the member 14$a_2$ by means of screws 104 or other fastening means.

Figure 5A:
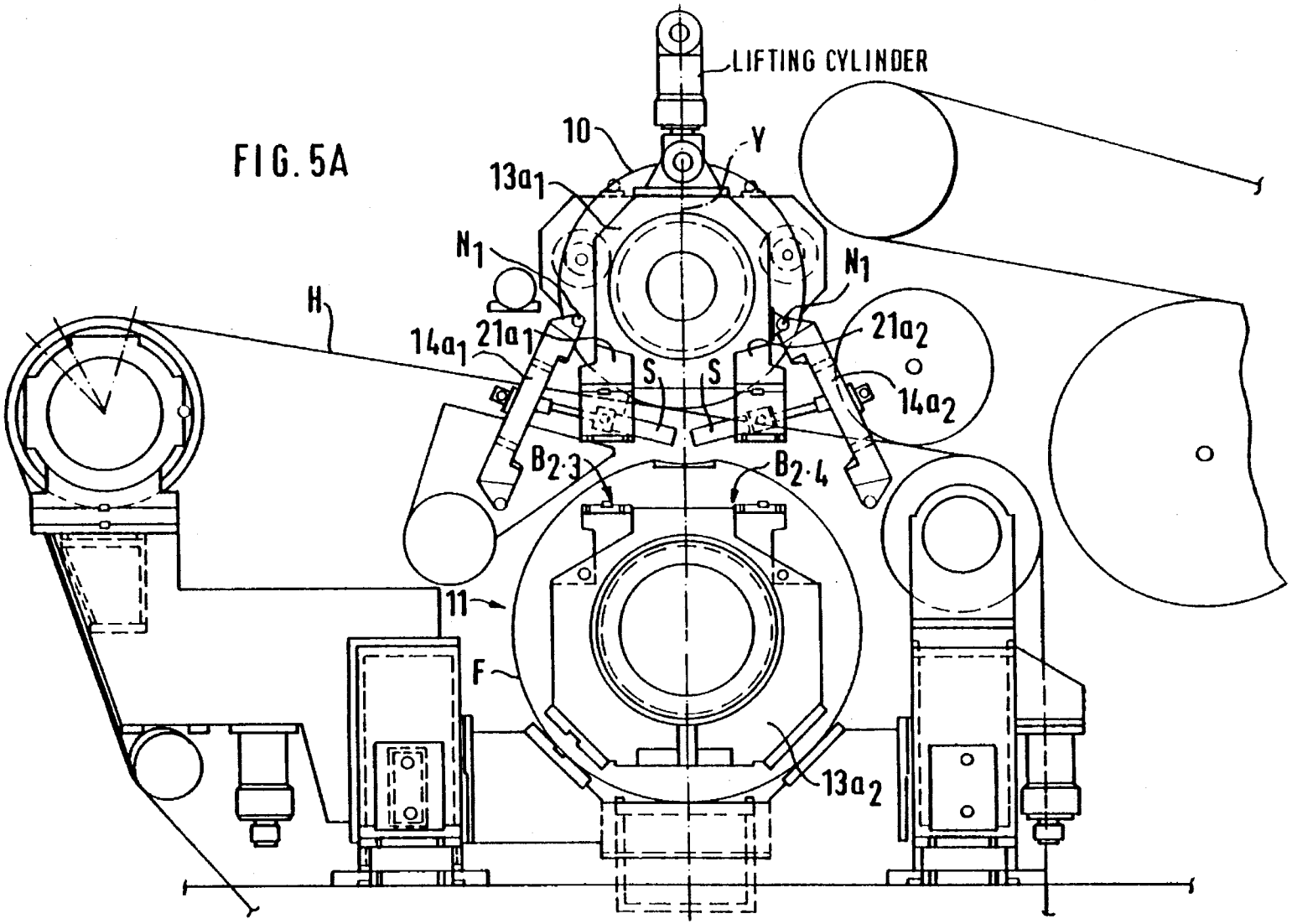
FIG. 5A shows an operation stage of the device in accordance with the invention in which the lower roll can be serviced.

FIG. 5A shows another embodiment of the present invention in an operational stage in which the tie members 14$a_1$,14$a_2$ are linked pivotally with the upper bearing housing and the tie members 14$a_1$,14$a_2$ are kept by means of the cylinder device S in a so-called open position. In this case, the lower roll and the lower bearing housing can be conditioned/detached upon release of the screws 43$a_2$ from the frame $R_2$ while the tie members 14$a_1$,14$a_2$ pivot about the articulation point $N_1$ and remain connected to the upper bearing housing.

Figure 5B:
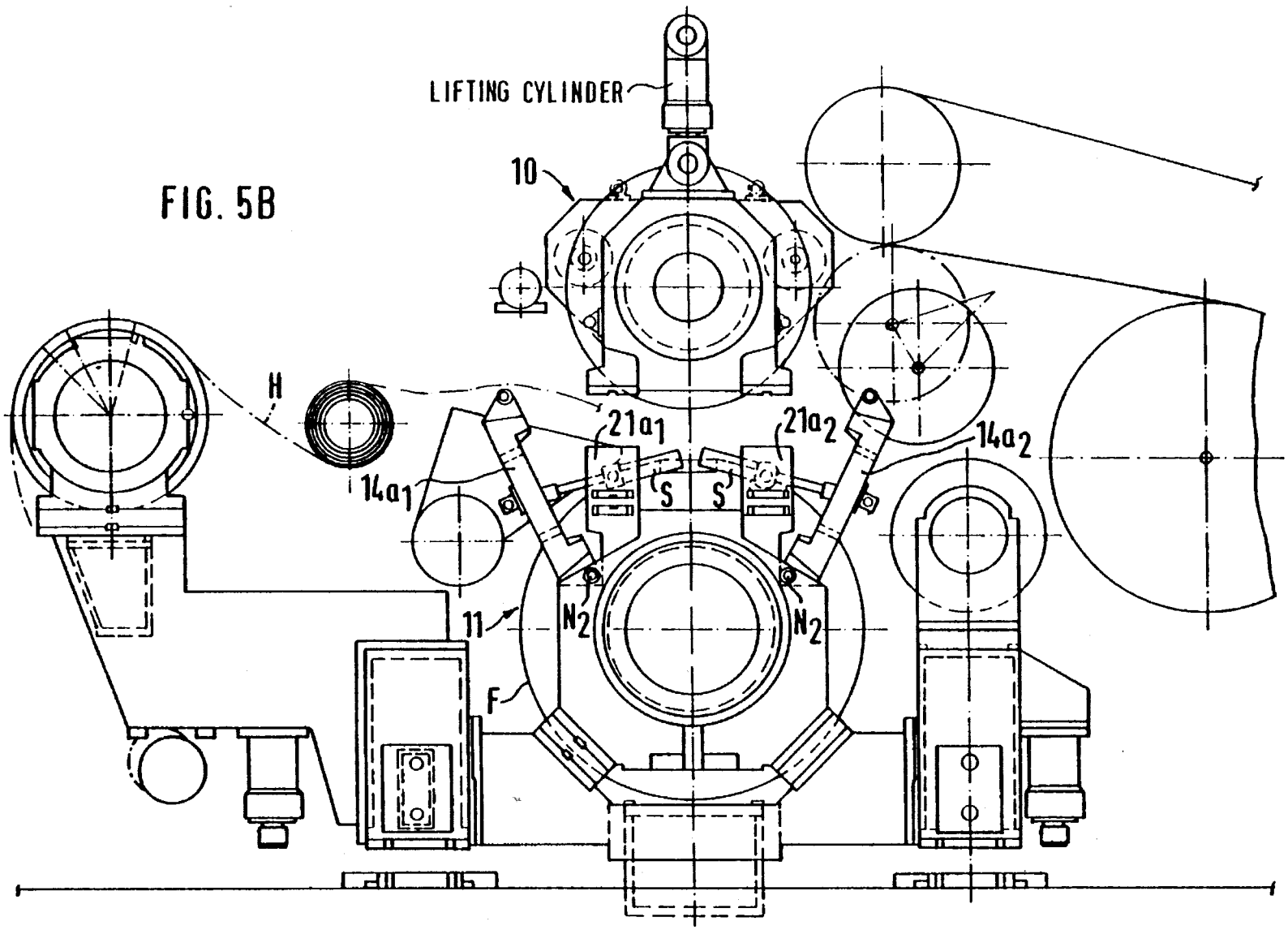
FIG. 5B shows a stage of the method in accordance with the invention in which the upper roll can be lifted off, for example, for servicing, the coupling means remaining in connection with the bearing housing of the lower roll.

FIG. 5B shows a coupling construction in accordance with the invention in a mode of operation in which the tie members 14$a_1$,14$a_2$ are linked pivotally with the lower bearing housing and the tie members are kept in a so-called open position by means of the cylinder device S. By means of the cylinder device S, the tie members are brought close to the bearing housing to be coupled, and the ultimate fixing and pressing of the tie member against its back-up face takes place by means of separate screw means.

The examples provided above are not meant to be exclusive. Many other variations of the present invention would be obvious to those skilled in the art, and are contemplated to be within the scope of the appended claims.

I claim:

1. Coupling construction for coupling a pair of press rolls in an extended-nip, one of the rolls comprising a belt mantle and loading means for loading and pressing said belt mantle towards the other roll, said press rolls being mounted in respective first and second bearing housings, comprising tie members, and connecting means for detachably connecting each of said tie members to said first and second bearing housings of said press rolls, said connecting means comprising pivot means for detachably, pivotally linking each of said tie members to each of said first and second bearing housings.

2. Coupling construction of claim 1, further comprising a coupling face arranged on said first and second bearing housings and a pair of said tie members connected to said first and second bearing housings at respective ends of said press rolls, said tie members being elongate and pivotable at a first end about an articulation point of said first bearing housing and pressable at a second end of said tie members opposite to said first end into contact with and against said coupling face of said second bearing housing.

3. Coupling construction of claim 1, wherein said tie members are arranged at respective ends of said press rolls symmetrically in relation to a vertical axis passing through center points of said press rolls.

4. Coupling construction of claim 1, further comprising a middle frame arranged between said bearing housings, said pivot means comprising a pivot cylinder coupled to each of said tie members and to said middle frame.

5. Coupling construction of claim 1, further comprising a middle frame arranged between said bearing housings and having a hollow interior, said pivot means comprising an elongate pivot cylinder coupled at a first end to each of said tie members and coupled at a second end opposite to said first end to said middle frame via an articulated joint, said pivot cylinder being at least partly situated in said hollow interior of said middle frame.

6. Coupling construction of claim 1, wherein said tie members are elongate and symmetrical about an axis perpendicular to the longitudinal axis, said tie members being pivotable about an articulation point situated at each end of said tie members.

7. Coupling construction of claim 1, wherein said tie members are elongate, and said pivot means comprise a bracket arranged at ends of said tie members and shafts insertable through said bracket and through a respective one of said first and second bearing housings.

8. Coupling construction of claim 1, wherein said first and second housings comprise a counter-coupling face arranged on a side face thereof, said tie members comprising an elongate middle frame and side frames arranged at both ends of said middle frame to form a U-section, the longitudinal axes of said side frames being substantially perpendicular to the longitudinal axis of said middle frame, said side frames comprising a coupling piece arranged on an inner face of the U-section, said coupling face being wedged into contact with said counter-coupling face of a respective one of said first and second bearing housings.

9. Coupling construction of claim 8, wherein said coupling piece is made of tin bronze.

10. Coupling construction of claim 1, wherein said connecting means further comprise screw holes in said tie members, tightening screws insertable through a portion of said screw holes, and detaching and tightening screws insertable through a remaining portion of said screw holes and into said first and second bearing housings of said press rolls.

11. Coupling construction of claim 1, wherein said pivot means comprise a hydraulic cylinder connected to said tie members and arranged to pivot said tie members between a position in which said tie members are separated from said bearing housings and a position in which said tie members are connectable to said bearing housings.

12. Coupling construction of claim 1, wherein said tie members comprise a through opening and coupling means arranged in connection with said opening for coupling said pivot means to said tie member.

13. Coupling means for coupling a pair of press rolls mounted in respective first and second bearing housings, comprising elongate tie members, and coupling means for selectively coupling each of said tie members to each of said first and second bearing housings of said press rolls, said coupling means comprising pivot means for pivoting each of said tie members relative to said first bearing housing to thereby separate or connect each of said tie members to said second bearing housing.

14. The coupling means of claim 13, wherein said pivot means comprise an elongate cylinder connected at a first end to each of said tie members and a frame construction positioned between said first and second bearing housings of said press rolls, said cylinder being connected at a second end opposite to said first end to said frame construction.

* * * * *